US005525077A

United States Patent [19]

Badaroux

[11] Patent Number: 5,525,077

[45] Date of Patent: Jun. 11, 1996

[54] ELECTRICAL CONNECTOR HOUSING MEMBER

[75] Inventor: Thierry Badaroux, Saint-Germain En Laye, France

[73] Assignee: Connecteurs Cinch, Montigny le Bretonneux, France

[21] Appl. No.: 257,300

[22] Filed: Jun. 9, 1994

[30] Foreign Application Priority Data

Jun. 15, 1993 [FR] France ..... 93 07188

[51] Int. Cl.[6] ..... H01R 13/40

[52] U.S. Cl. ..... 439/595

[58] Field of Search ..... 439/595, 744, 439/752

[56] References Cited

U.S. PATENT DOCUMENTS 5,069,639 12/1991 Kodama et al. .
5,071,369 12/1991 Denlinger et al. .
5,108,310 4/1992 Sawada et al. ..... 439/752 X
5,256,084 10/1993 Kodama ..... 439/595 OR
5,425,656 6/1995 Wakata ..... 439/595 OR

FOREIGN PATENT DOCUMENTS 2673047 8/1992 France .
2684242 5/1993 France .
2262664 6/1993 United Kingdom .

OTHER PUBLICATIONS

French Search Report With Annex.

*Primary Examiner* Larry I. Schwartz
*Assistant Examiner* Daniel Wittels
*Attorney, Agent, or Firm* Greenblum & Bernstein

[57] ABSTRACT

An electrical connection housing member comprises a body with passages and a retaining lug for an electrical contact member. The body includes slideways with detents for receiving a locking member which has an end wall and locking bars which cooperate with the detents and steps to lock the resilient lugs.

3 Claims, 7 Drawing Sheets

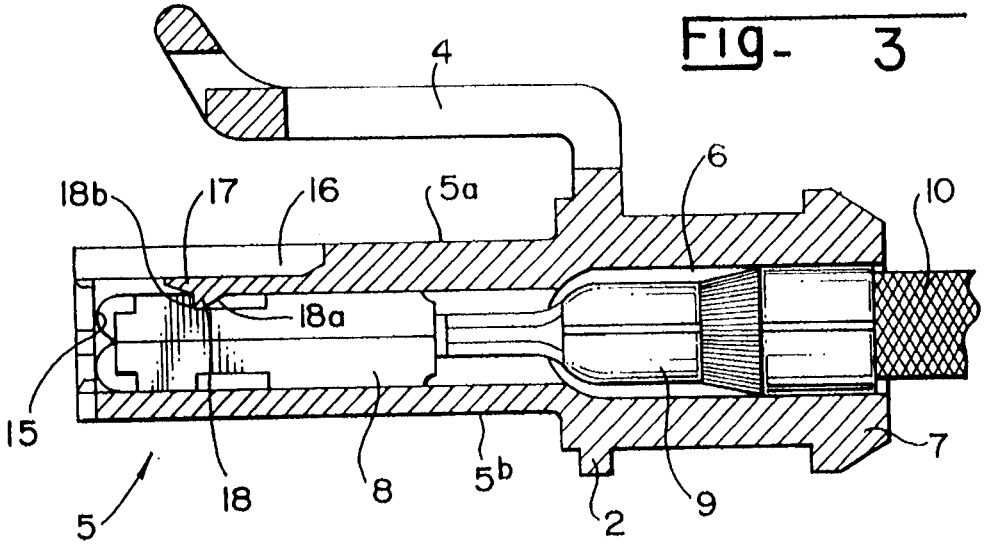
Fig- 3
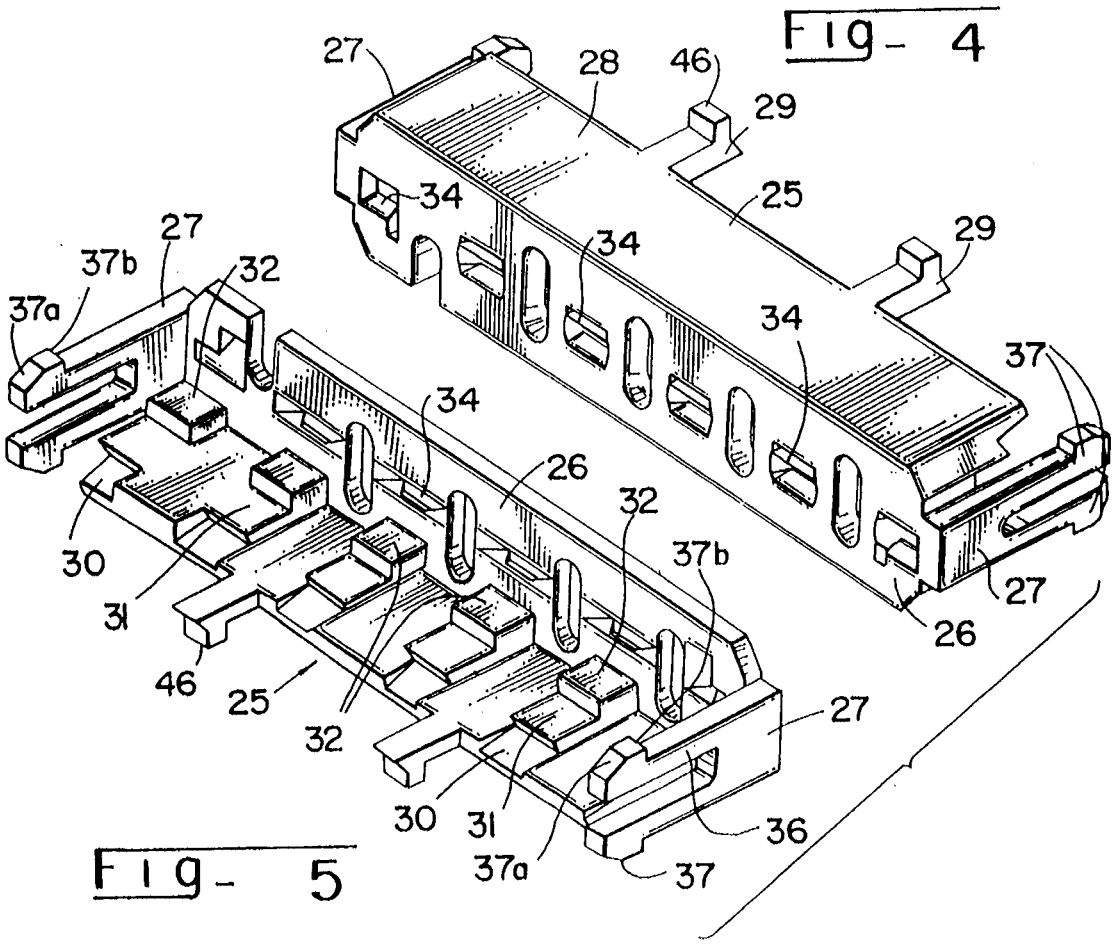
Fig- 4
Fig- 5

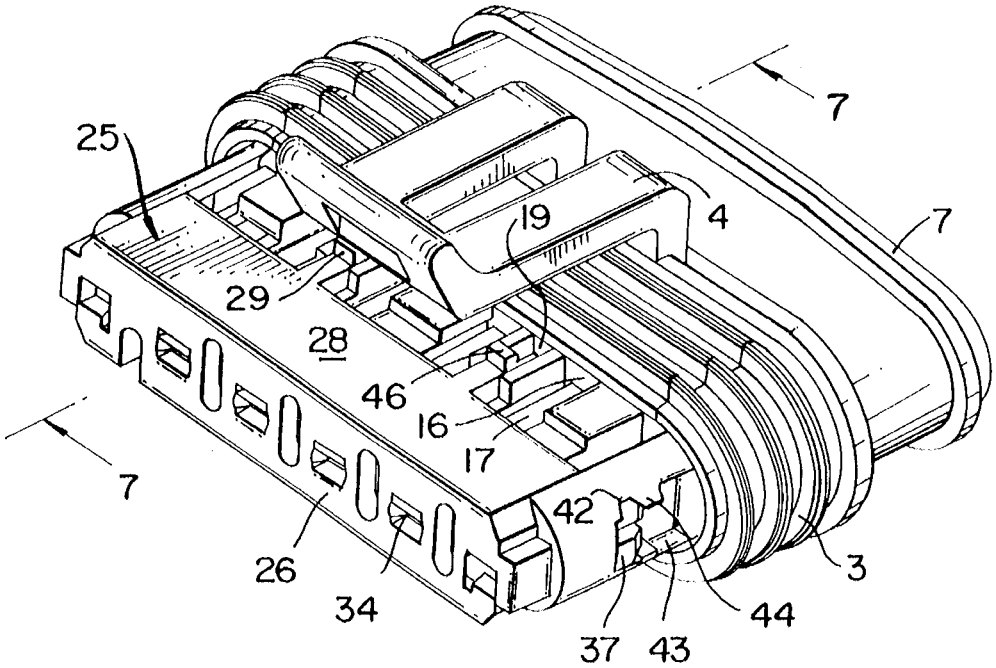
Fig- 6
Fig- 7
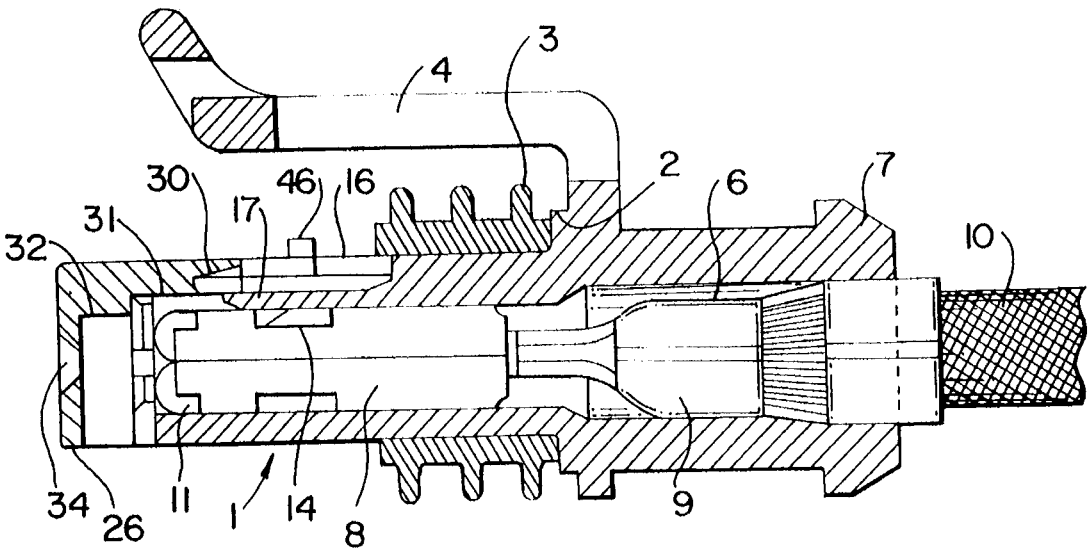

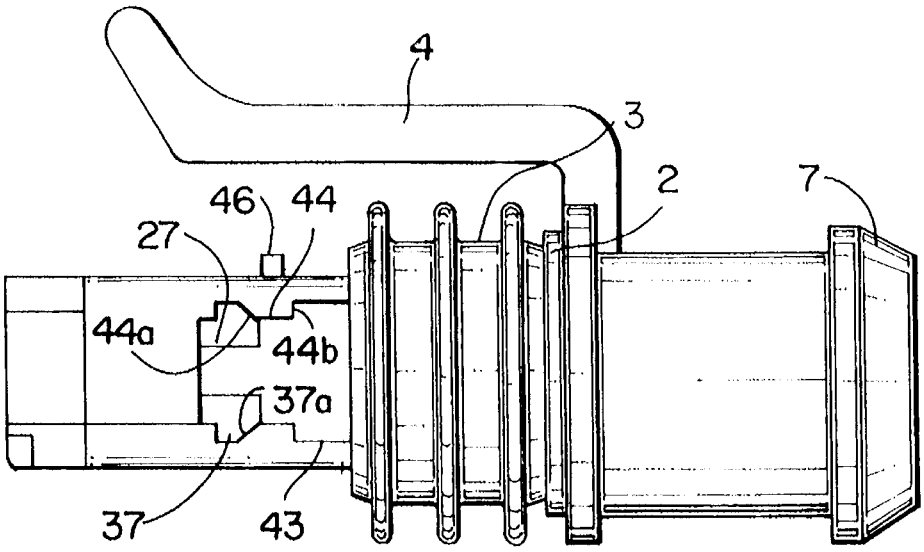
Fig- 8
Fig- 9
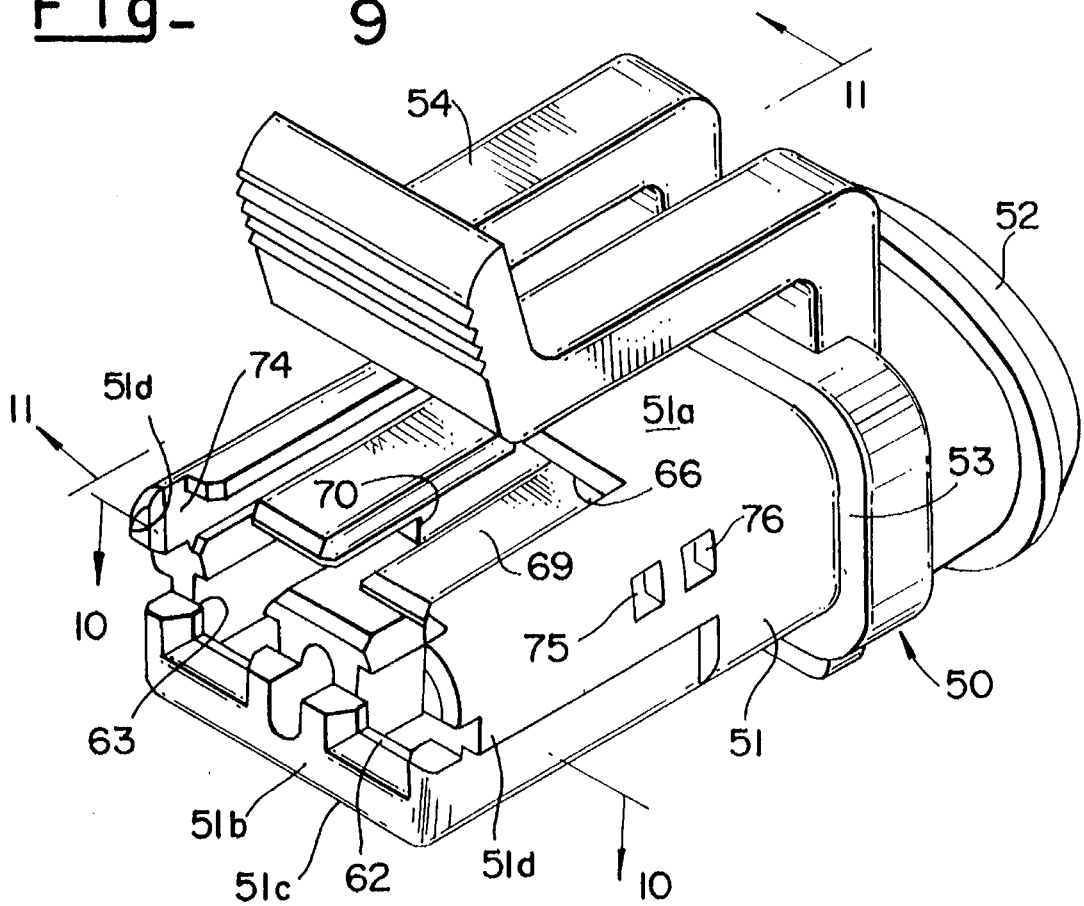

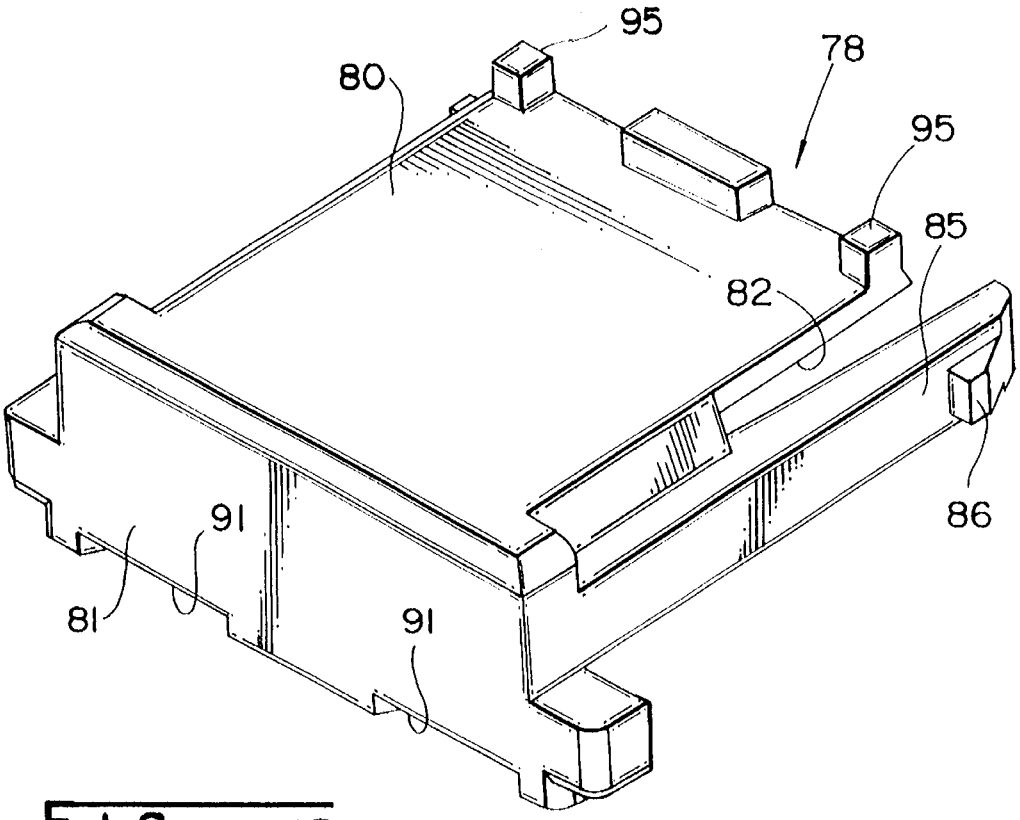
Fig- 12
Fig- 13
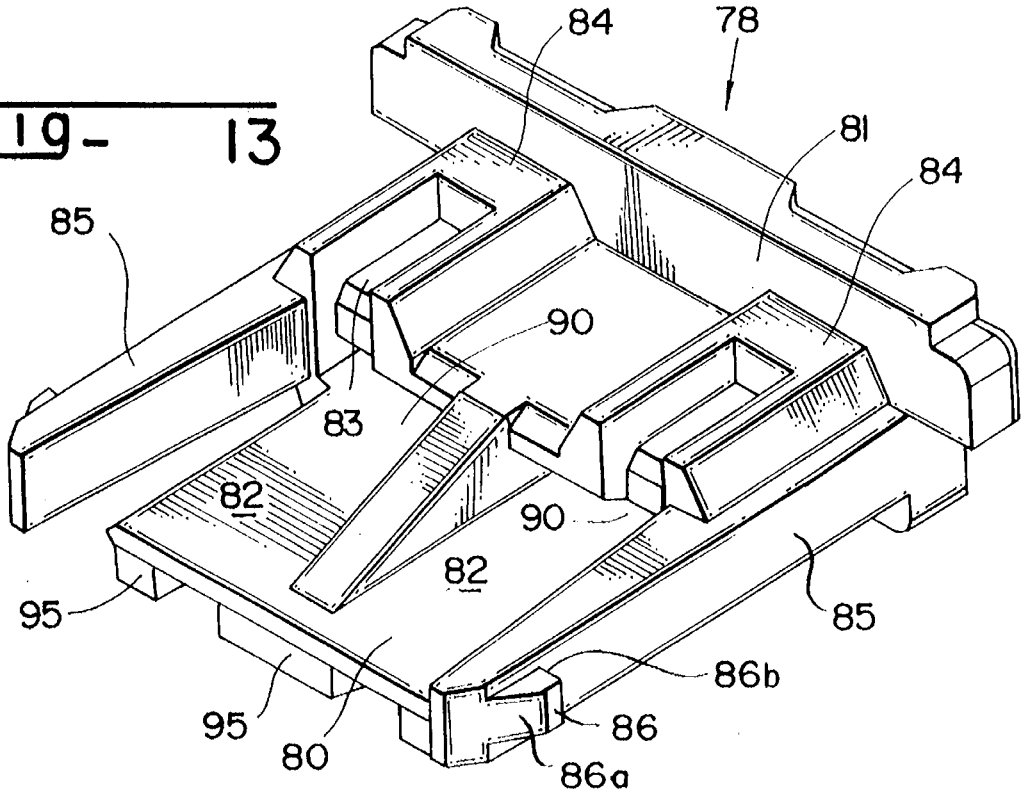

ELECTRICAL CONNECTOR HOUSING MEMBER

BACKGROUND OF THE INVENTION

1. Field of the Invention

The present invention concerns an electrical connector housing member.

2. Description of the Prior Art

The invention concerns an electrical connector housing member including passages accommodating electrical contact members which are held in place by resilient lugs provided with projections so that when the contact members are fitted the resilient lugs retract resiliently, their projections immobilizing said members when properly housed in the passages.

Housing members of this kind include a locking member for immobilizing the resilient lugs.

An object of the present invention is to provide an electrical connector housing member which facilitates fitting the electrical contact members and which is highly secure.

SUMMARY OF THE INVENTION

The invention consists in an electrical connector housing member, comprising a body in which there are passages each adapted to receive an electrical contact member, said body including in each passage a resilient lug having on the side facing towards the interior of the passage a projection having a ramp surface on the side towards an end of said passage from which the electrical contact member is inserted and an abrupt surface on the opposite side, said projection being adapted to cooperate with a retaining opening in said electrical contact member, said body including an opening on the side facing the side of the resilient lug opposite that having the projection on it and a locking member for said resilient lug adapted to occupy a standby position and a position in which it locks the latter and being formed by a cover wall adapted to be inserted in the opening of an end wall adapted to cooperate with the end of the body opposite that from which electrical contact members are inserted, the side of said cover wall facing toward the resilient lugs having steps offset so that when the locking member is engaged with the body the locking member occupies the standby position in which the resilient lugs can move freely to enable fitting of the electrical contact members whereas when the locking member occupies the locking position the steps bear against said resilient lugs to lock them, in which housing member the body includes on the side opposite the ends of the passages from which the electrical contact members are inserted, and along two opposite edges, a slideway having, along its length, first and second detents whereas the locking member has, along two opposite edges, a locking bar adapted to engage in the slideways of the body, each locking bar having an abutment near its free end adapted to cooperate selectively with the detents.

The invention is described in more detail below with reference to specific embodiments of the invention shown in the appended drawings by way of example only.

BRIEF DESCRIPTION OF THE DRAWINGS

FIG. 3 is a view in section on the line 3—3 in FIG. 1.

FIG. 4 is a perspective view of the locking member for the electrical contact members.

FIG. 5 is a perspective view of the locking member for the electrical contact members.

FIG. 6 is a perspective view of the housing member from FIG. 1 with the locking member in a standby position.

FIG. 7 is a view in section on the line 7—7 in FIG. 6.

FIG. 8 is a side elevation view of the housing member from FIG. 6.

FIG. 9 is a perspective view of an alternative embodiment of housing member.

FIG. 12 is a perspective view of an electrical contact member locking member.

FIG. 13 is a perspective view of the locking member.

DETAILED DESCRIPTION OF THE PREFERRED EMBODIMENTS

Figure 1:
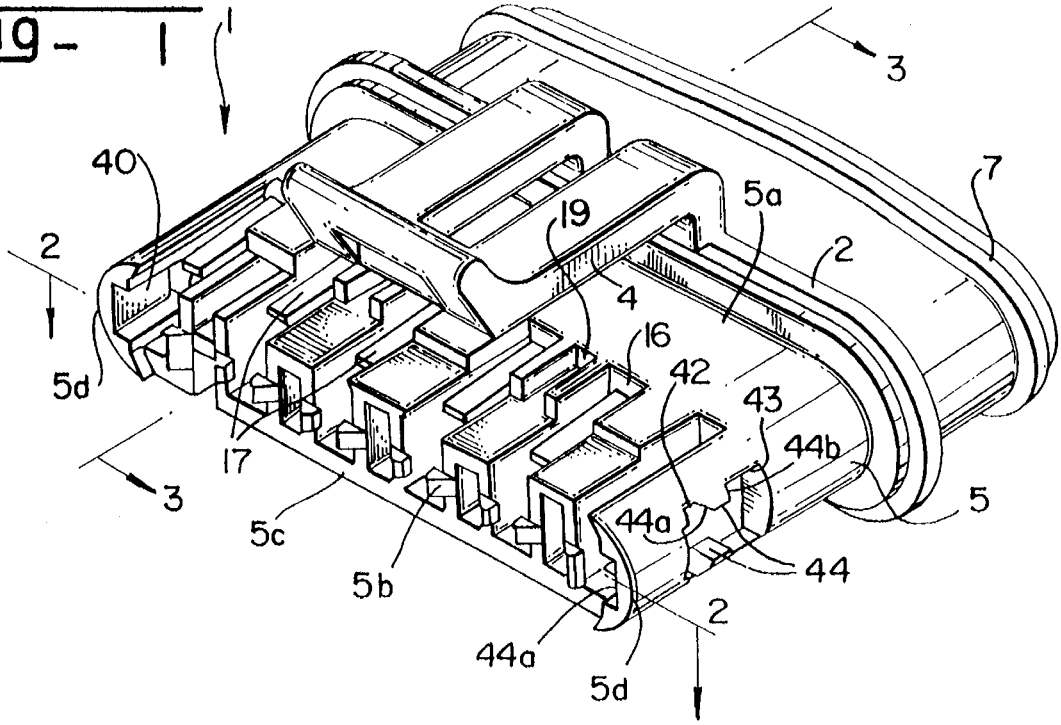
FIG. 1 is a perspective view of an electrical connector housing member.

FIGS. 1 to 8 show a housing member 1 having an external shoulder 2 for retaining a resilient seal 3 and a resilient lug 4 for locking it to a complementary member (not shown) having a skirt into which a male end 5 of said member 1 is inserted.

The male end 5 has a ceiling wall 5*a*, a floor wall 5*c*, two lateral walls 5*d* and an anterior end 5*b*.

The member 1 has a series of passages 6 which are open at one end 7 to enable the insertion of electrical contact members 8 which have crimping lugs 9 for attaching an electrical conductor 10 at one end and a resilient receptacle 11 designed to grip a male tongue mounted in the complementary female member at the other end.

The female electrical contact member 8 has a retaining opening 14 in its body.

Each passage 6 has at the end 5*d* lateral abutments 15 for retaining the resilient receptacle 11. Openings 16 are formed in line with each passage 6 in the wall 5*a* of said male end 5, on the side facing the resilient lug 4. Resilient lugs 17 face the openings 16.

On the side towards the interior of each passage 6 each resilient lug 17 has a projection 18 with a ramp surface 18*a* on the side from which the members 8 are inserted and an abrupt surface 18*b* on the side towards the abutments 15.

Two slots 19 are formed in the wall 5*a*.

FIGS. 4 and 5 show a locking member 25 for the contact members 8 in perspective.

The member 25 comprises a body with a cover wall 28, two lateral locking bars 27 and an end wall 26.

The wall 28 is extended by two lugs 29 adapted to engage in the slots 19 and its inside surface 25*a* has steps 30, 31 and 32 in the portions adapted to be aligned with the passages 6, in the openings 16. The steps 30 are recessed while the steps 31 and 32 project.

The free ends of the lugs 29 include abutments 46 adapted to retain the seal 3.

The end wall 26 has slots 34 adapted to align with the ends of the passages 6 including the abutments 15 and allowing male contacts to pass through them.

The lateral locking bars 27 comprise two branches with abutments 37 at their free end, each abutment having a ramp surface 37*a* facing away from the adjacent branch and an abrupt surface 37*b*.

Figure 2:
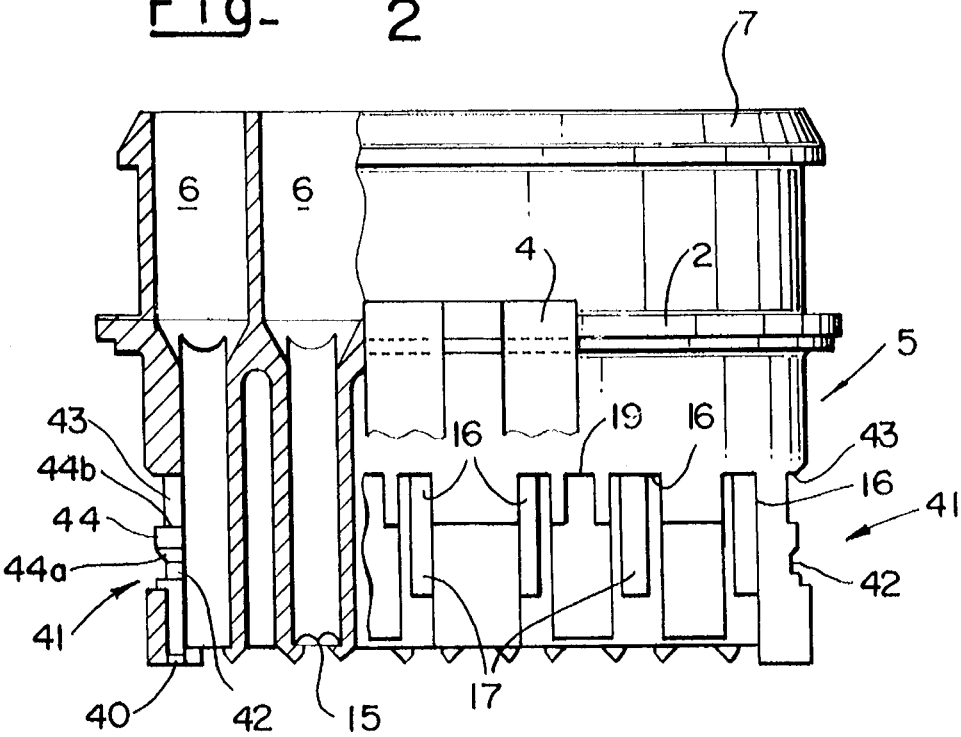
FIG. 2 is a view in section on the line 2—2 in FIG. 1.
Figure 10:
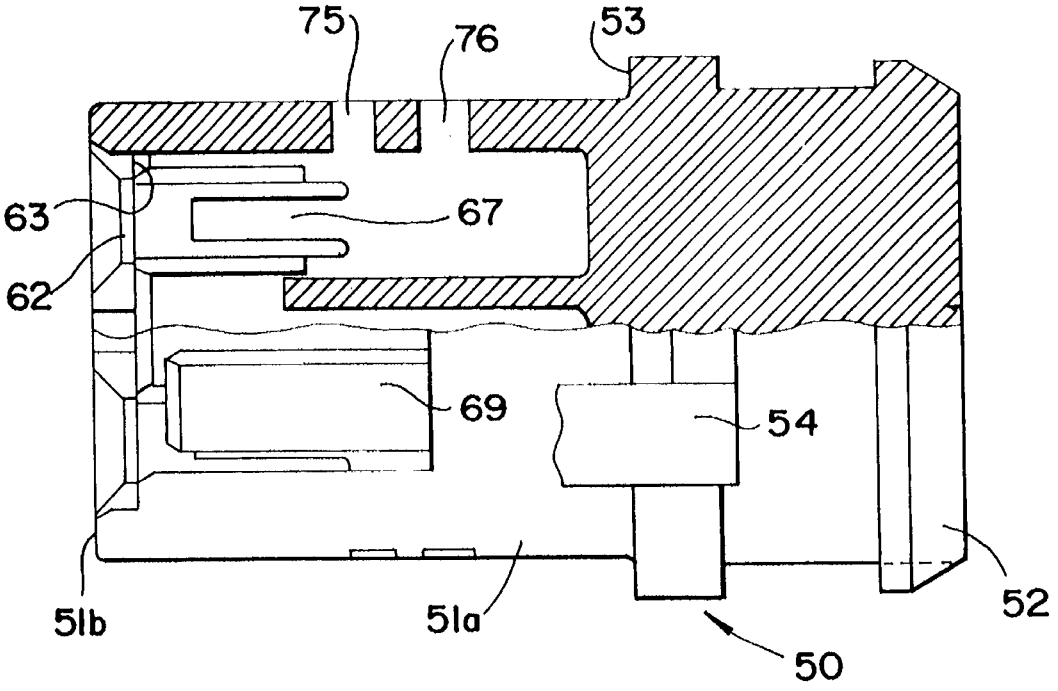
FIG. 10 is a view in section on the line 10—10 in FIG. 9.
Figure 11:
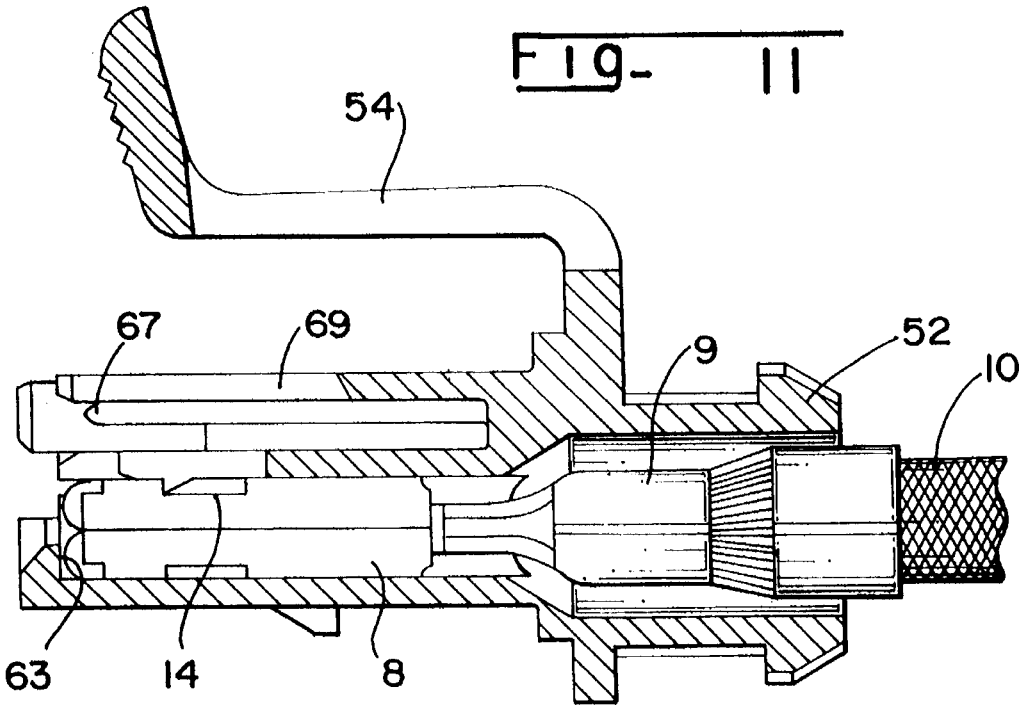
FIG. 11 is a view in section in the line 11—11 in FIG. 10.
Figure 14:
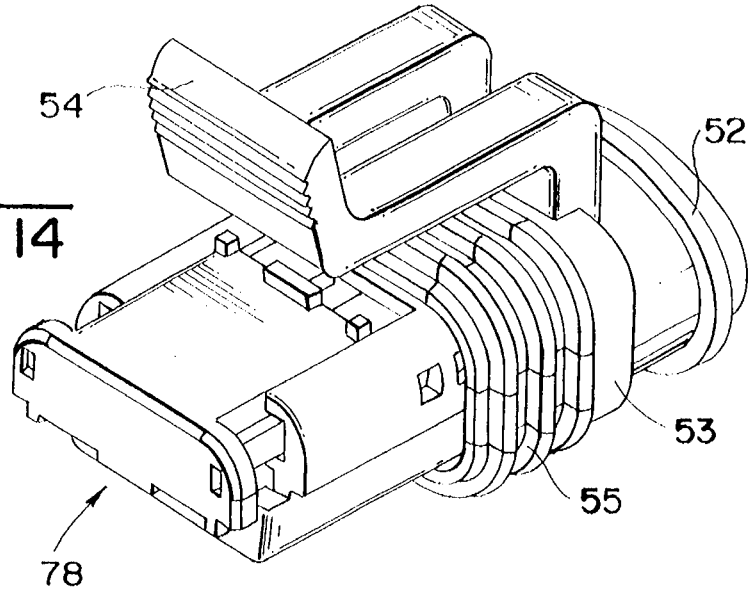
FIG. 14 is a perspective view of the housing member with the locking member in a standby position.
Figure 15:
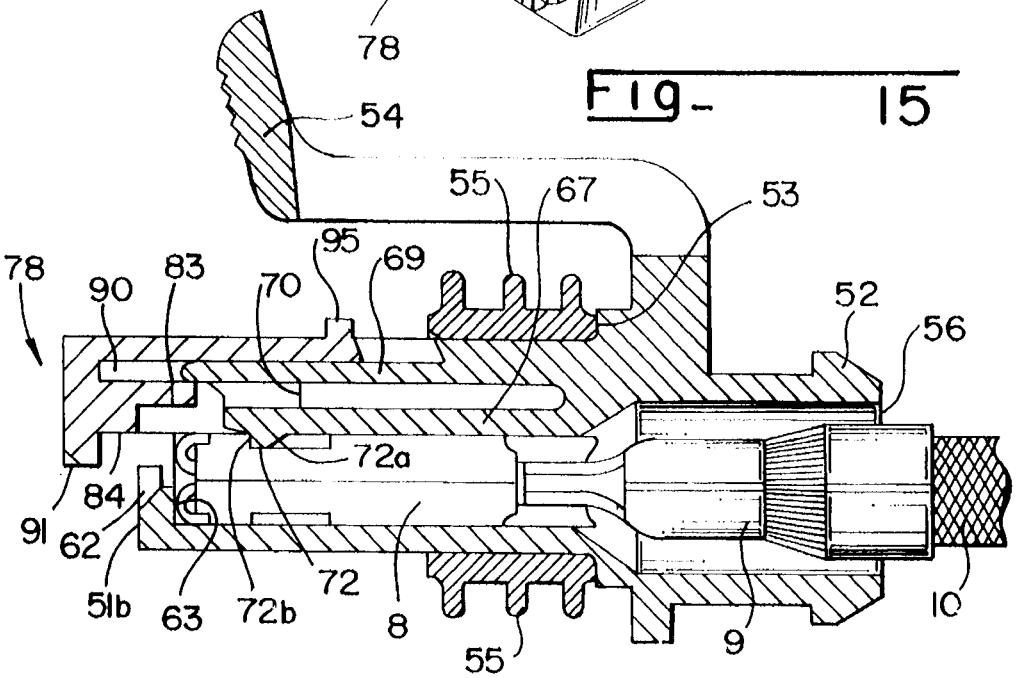
FIG. 15 is a view in section on the line 15—15 in FIG. 14.
Figure 16:
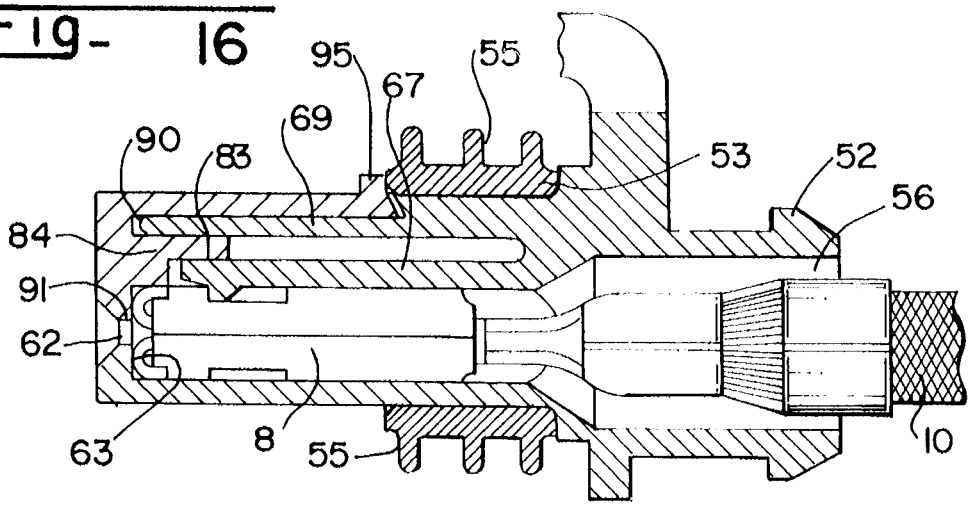
FIG. 16 is a view similar to FIG. 15 showing the locking member in a locked position.

Referring to FIGS. 1 and 2, the male end 5 has two slideways 40 extending from the free end to slots 41. Each slot 41 has a first detent 42 and a second detent 43 separated by pegs 44 which have ramp surfaces 44*a* on the side towards the detents 42 and abrupt surfaces 44*b* on the side towards the detents 43.

The member 25 is mounted at the end 5*b* of the male end 5 so that its surface 25*a* contacts the surface 5*a* with the receptacles 27 inserted in the slideways 40 and the abutments 37 in the detents 42. In this standby position the lugs 17 can move resiliently and it is therefore possible to fit the members 8, which are inserted so that the projections 18 enter the openings 14. The member 25 is then pushed in, the ramp surface 37*a* of the abutments 37 cooperating with the ramp surface 44*a*, escaping from the detent 42 and lodging in the detent 43 behind the abrupt surface 44*b*. In this position the member 25 can no longer be unlocked inadvertently and the resilient lug 17 cooperates with the step 31 so that it can no longer bend resiliently. The step 32 is aligned with the side of said lug 17 facing the interior of the passage so that the member 8 is held in the passage 6 without play. Note that if the electrical contact member 8 is not inserted into the passage 6 in such a way as to be locked by the projection 18 of the resilient lug 17 properly inserted into the retaining opening 14, then said lug 17 will remain raised and the edge of the step 31 will abut against the free end of said lug, so opposing locking of the member 25.

FIGS. 9 to 16 shows a second embodiment of the invention.

FIG. 9 shows a male housing member having a body 50 with a male end 51 formed by two lateral walls 51*d*, a floor wall 51*c*, a ceiling wall 51*a* and an anterior end 51*b*.

The body 50 includes an abutment 53 for a seal 55 and has a posterior end 52.

On the same side as the ceiling wall 51*a* it has a resilient locking lug 54 adapted to cooperate with a peg on a female member (not shown).

The body 50 includes two passages 56 which are open at the posterior end 52 to enable the insertion of a female electrical contact member 58 having a receptacle 59 for gripping a male contact at one end and lugs 60 for crimping it to an electrical conductor at the other end, the body of said member having a retaining opening 61 in it.

At the anterior end 51*b*, each passage 56 includes abutments 63 and the ceiling wall 51*a* has an opening 66.

In the opening 66 is a resilient lug 67 in line with each passage 56 and, above each resilient lug 67, a guide bar 69 having a shoulder 70.

On the side facing towards the inside of the passage 56 each resilient lug 67 has a projection 72 having on the side towards the anterior end 51*b* an abrupt surface 72*b* and on the opposite side a ramp surface 72*a*.

On the same side as the lateral walls 51*d* the body 50 includes slideways 74 having detents 75 and 76 partway along their length.

FIGS. 12 and 13 show a locking member 78 for the contact members 58 in perspective. It has a cover wall 80 and an end wall 81, the cover wall 80 having on its inside surface steps 82, 83 and 84 and a slot 90 receiving the guide bars 69.

The free end of the cover wall 82 has abutments 95 for retaining the seal 55 on the side opposite the steps 82, 83 and 84.

At the sides the member 78 has locking bars 85 which have at their outward free ends abutments 86 including a ramp surface 86*a* and an abrupt surface 86*b* facing towards the end wall 61.

Notches 91 in the wall 81 are adapted to align with the abutments 63 to forms slots 62 through which male contacts can be inserted into the receptacles 59.

The member 78 is mounted on the member 50 by engaging the immobilizing bars 85 in the slideways 74 until the abutments 86 insert in the detents 75. In this position (see FIG. 15) the resilient lugs 67 are free to move and the contact members 58 can be inserted into the passages 56 from the end 52 until they bear through the receptacle 59 against the abutment 63, resiliently raising the lugs 67 until the projections 72 enter the openings 61. The member 78 is then pushed in, its abutments 86 escaping from the detents 75 to engage in the detents 76. In this position the steps 83 bear on the side of the lugs 67 opposite that with the projection 72, with a result that said lugs are immobilized.

The steps 84 align with the side of the lugs 67 facing towards the inside of the passages with the result that the members 58 are locked in the passages 56 without play.

Note that if any of the members 58 is not properly located in the respective passage, the lugs 67 remaining raised, it is impossible to move the member 78 into the locking position, the edge of the step 83 abutting against the free end of said lugs 67.

Of course, the invention is not limited to the embodiments shown and described. Numerous modifications of detail can be made thereto without departing from the scope of the invention.

There is claimed:

1. Electrical connector housing member, comprising a body in which there are passages each adapted to receive an electrical contact member, said body including in each passage a resilient lug having on the side facing towards the interior of the passage a projection having a ramp surface on the side towards an end of said passage from which the electrical contact member is inserted and an abrupt surface on the opposite side, said projection being adapted to cooperate with a retaining opening in said electrical contact member, said body including an opening on the side facing the side of said resilient lug opposite that having said projection on it and a locking member for said resilient lug adapted to occupy a standby position and a position in which it locks the latter and being formed by a cover wall adapted to be inserted in the opening of an end wall adapted to cooperate with the end of said body opposite that from which said electrical contact members are inserted, the side of said cover wall facing toward said resilient lugs having steps offset so that when said locking member is engaged with said body the locking member occupies said standby position in which said resilient lugs can move freely to enable fitting of said electrical contact members whereas when said locking member occupies said locking position said steps bear against said resilient lugs to lock them, in which housing member said body includes on the side opposite the ends of said passages from which said electrical contact members are inserted, and along two opposite edges, a slideway having, along its length, first and second detents whereas said locking member has, along two opposite edges, a locking bar adapted to engage in said slideways of said body, each locking bar having an abutment near a free end adapted to cooperate selectively with said detents.

2. Electrical connection housing member according to claim 1 wherein said locking bars have two branches including at their free end, on their outside surface, abutments having a ramp surface on the side towards the free end and an abrupt surface on the opposite side, whereas said first detents are formed in slots separated from said second detents by pegs which have a ramp surface on the side towards said first detents and abrupt surfaces on the side towards said second detents.

3. Electrical connection housing member according to claim 1 wherein said body is provided with a seal and a free end of the cover wall of said locking member has an abutment for retaining said seal.

* * * * *